US005992736A

United States Patent [19]

Parker

[11] Patent Number: 5,992,736

[45] Date of Patent: Nov. 30, 1999

[54] SECURITY MAILBOX

[76] Inventor: Robert E. Parker, 1011 S. Laughingbrook Ct., Anaheim, Calif. 92808

[21] Appl. No.: 09/134,950

[22] Filed: Aug. 17, 1998

[51] Int. Cl.[6] ..... B65D 91/00

[52] U.S. Cl. ..... 232/17; 232/43.1; 232/45

[58] Field of Search ..... 232/17, 45, 43.1, 232/24, 25, 27, 38, 33, 47, 4 D; 109/55, 46

[56] References Cited

U.S. PATENT DOCUMENTS

| | | | |
|---|---|---|---|
| D. 360,741 | 7/1995 | Bohlmann . | |
| 2,690,870 | 10/1954 | Harman | 232/4 D |
| 3,070,234 | 12/1962 | Deitchman . | |
| 3,401,875 | 9/1968 | Bruhns | 232/4 D |
| 3,880,344 | 4/1975 | Earle . | |
| 4,190,192 | 2/1980 | Cornwell, Jr. et al. . | |
| 4,557,416 | 12/1985 | Stahl et al. | 232/24 |
| 4,648,550 | 3/1987 | Cleary, Jr. | 232/25 |
| 4,724,999 | 2/1988 | Fitzgerald et al. | 232/17 |
| 4,844,332 | 7/1989 | Long . | |
| 4,905,891 | 3/1990 | Wildish et al. . | |
| 4,993,626 | 2/1991 | Berry . | |
| 5,056,711 | 10/1991 | Bush | 232/17 |
| 5,071,063 | 12/1991 | Overstreet . | |
| 5,096,115 | 3/1992 | Hassan . | |
| 5,351,883 | 10/1994 | Pachl . | |
| 5,400,960 | 3/1995 | Jeffs . | |
| 5,526,979 | 6/1996 | Mann | 232/33 |
| 5,758,819 | 6/1998 | Sniegocki | 109/55 X |

*Primary Examiner*—Brian K. Green
*Assistant Examiner*—William L. Miller
*Attorney, Agent, or Firm*—James G. O'Neill

[57] ABSTRACT

An improved security mailbox having a combination mail receiving and outgoing mail portion, securely held within an opening formed in a wall of a rectangular housing. The combination mail receiving and outgoing mail portion includes a top chamber which holds outgoing mail, and a bottom slot which connects to an inner chamber formed in the rectangular housing. Mail collects on a shelf secured in the inner chamber, and is accessible from a lockable door either in the front or rear wall. The shelf may be bare or have tiles thereon for easy cleaning, and the top of the housing is securely capped, while the base of the housing may be secured to the ground in any desired manner, or to a concrete support base. A plurality of combination mail receiving and outgoing mail portions may be secured in the housing, and an equal number of shelves and lockable doors may be provided.

2 Claims, 2 Drawing Sheets

SECURITY MAILBOX

BACKGROUND OF THE INVENTION

1. Field of the Invention

This invention relates generally to mailboxes, and, more particularly, to a security mailbox to secure incoming mail for at least one entity, against theft.

2. Description of Related Art

With the increase in value of items being received in the mail, a need for a stand-alone security mailbox, which is both attractive and will resist the attempts of dedicated thieves to open the same, is becoming more and more important for residences, small businesses, and the like. Prior art security-type mailboxes are known in which elongated passages or blocking elements are included to prevent a thief from inserting their arm or a device into the mail receiving slot to take the mail out. Other devices are also known which have a strong outer layer thereon, such as concrete, or the like. Examples of such known prior art devices are set forth in U.S. Pat. Nos. Des. 360,741 to Bohlmann, 3,070,234 to Deitchman, 3,880,344 to Earle, 4,190,192 to Cornwell, Jr. et al., 4,844,332 to Long, 4,905,891 to Wildish et al., 5,071,063 to Overstreet, 4,993,626 to Berry, 5,096,115 to Hassan, 5,351,883 to Pachl and 5,400,960 to Jeffs.

The known devices have contributed to the art and have provided improvements in some areas. However, none of the known devices provide the required security in all instances, are aesthetically pleasing and can be adapted to serve one or more homeowners, apartment dwellers, or small businesses.

Therefore, there exists a need in the art for an improved, high quality, security mailbox, having an attractive exterior, and an interior which is difficult to break into so as to thwart thieves or vandals from stealing the mail inserted and held therein.

SUMMARY OF THE INVENTION

Accordingly, it is a general object of the present invention to provide an improved security mailbox. It is a particular object of the present invention to provide an improved security mailbox, which is aesthetically pleasing and easy to use. It is another particular object of the present invention to provide an improved security mailbox made of natural materials found in homes, such as stucco, brick, wood siding, or the like. It is a further particular object of the present invention to provide an improved security mailbox which is easy to install. It is a still further particular object of the present invention to provide an improved security mailbox having a plurality of secured mail receiving areas and a plurality of separate outgoing mail areas therein. And, it is a still a further particular object of the present invention to provide an improved security mailbox having a unitary mail receiving slot, and an enclosure for holding outgoing mail, and which has at least one locked door at the rear thereof for gaining access to the mail held within one or more secured openings within the mailbox.

These and other objects and advantages of the present invention are achieved by providing a housing having at least one opening in a face thereof, which opening has a specifically sized and dimensioned combination mail receiving slot and outgoing mail holding tray therein. At least one further opening with a locking metallic door therein is also provided in the housing. The security mailbox of the present invention may include a plurality of boxes held in a cluster, in an aesthetically pleasing, rectangular housing, having a top cap thereon, and which is securely held to the ground, for serving a number of separate apartments, businesses or residences.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention, and sets forth the best modes contemplated by the inventor of carrying out his invention. Various modifications, however, will remain readily apparent to those skilled in the art, since the generic principles of the present invention have been defined herein, specifically to describe a novel and improved security mailbox generally indicated at 10.

Figure 4:
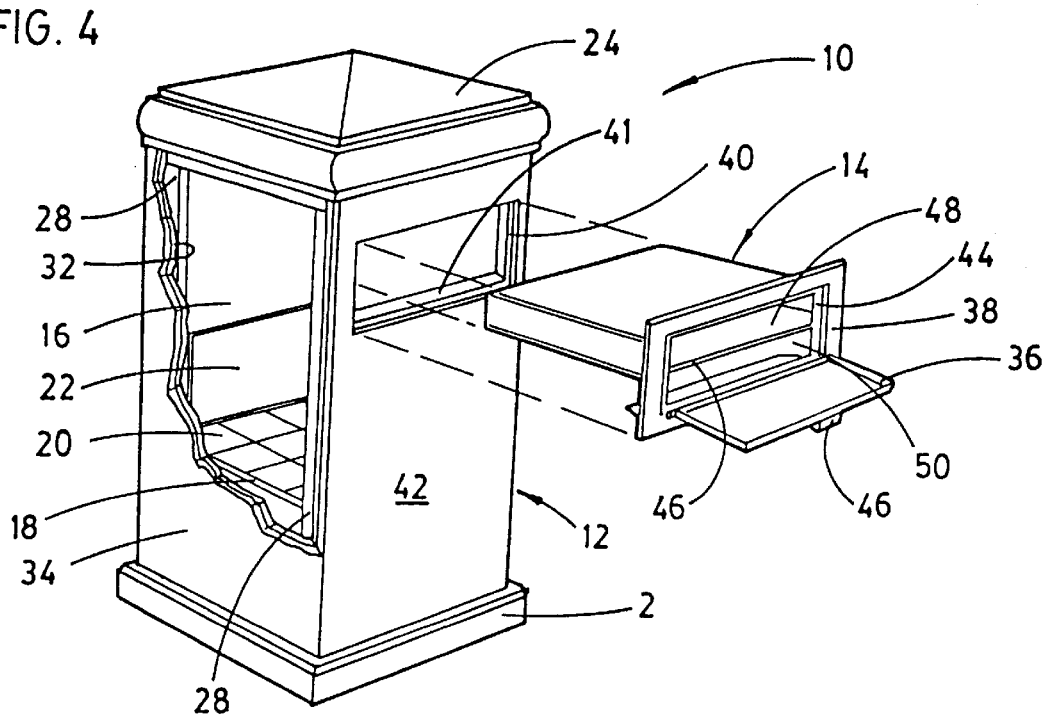
FIG. 4 is a further front perspective view of the security mailbox of FIG. 1, with a side wall partially broken away and the unitary mail receiving slot and outgoing mail holding portion of exploded from the front face.
Figure 5:
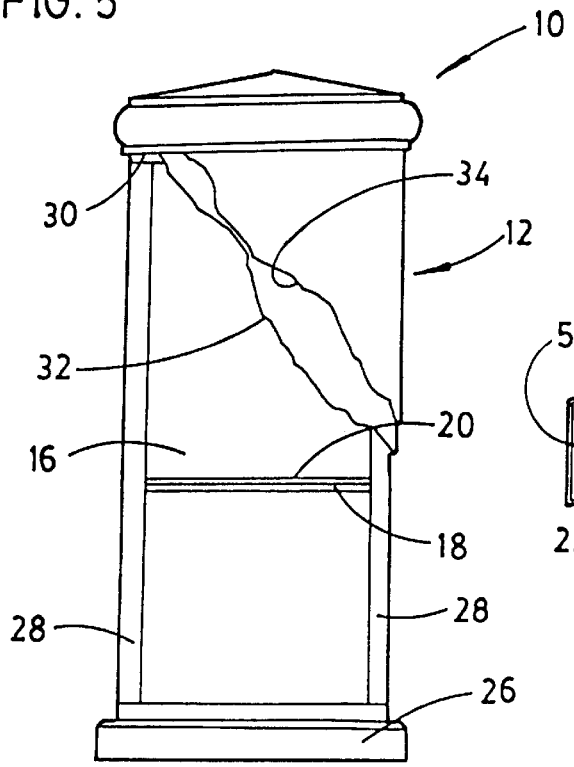
FIG. 5 is a rear elevational view of the security mail box of FIG. 1, with the rear wall partially removed to show a holding shelf for mail supported therein.
Figure 6:
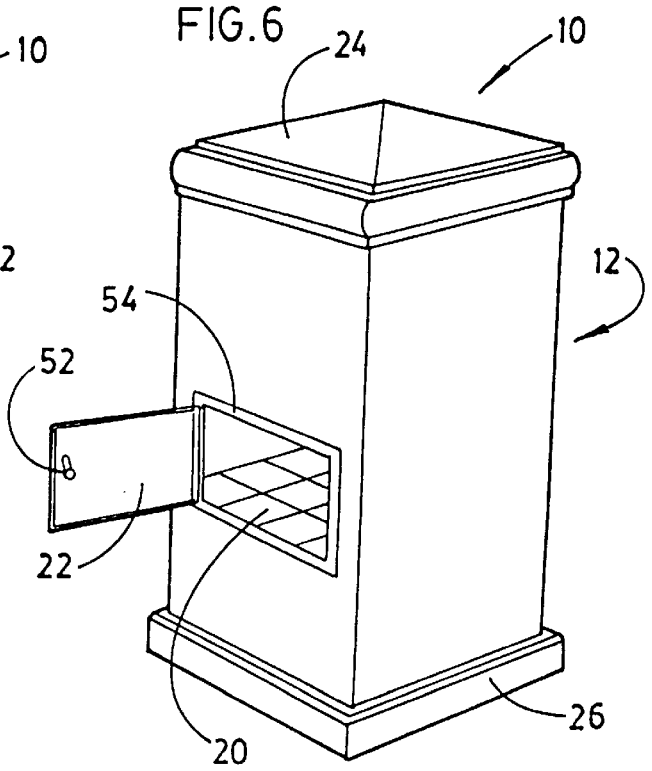
FIG. 6 is a rear perspective view of the mailbox of FIG. 1, with a rear security door in an opened position.

Turning to the drawings, there shown is the mailbox 10 set at a curbside, as recommended by the Post Office, where a postman has easy access from the street, and an apartment dweller, business owner or home owner has easy access from the sidewalk. The mailbox comprises a single rectangular housing 12, having a pair of side walls and front end rear walls, with a combination or unitary mail receiving and outgoing mail portion 14 securely held in the front wall. An internal chamber 16 is formed between the walls, and has a shelf 18 supported therein. The shelf 18 has a flat surface which may be provided with a plurality of tiles 20 secured to the top surface thereof, for receiving and supporting mail within the internal chamber 16. As best shown in FIG. 4, mail arrives in the inner chamber 16 by being inserted in a lower slot 50 and dropping to tiles 20 on shelf 18. Mail is picked up by a user by opening a door 22, such as a front locking door (not shown), or a rear lockable door (FIG. 6) to gain access to the internal chamber 16. The rectangular housing 12 is preferably formed so as to be strong and resilient, and includes a top sealing cap 24 and a base 26 secured to the housing, as by nailing, or by use of other fastening elements. A plurality of strong internal members, such as 2×3 or 2×4 vertical corner elements 28 and horizontal top and bottom elements 30 provide internal strength and support to the housing 12. The base 26 and bottom elements 30 may be secured to a concrete pad, or any other available surface, by bolts or other fasteners, so that the mailbox 10 cannot be moved after being secured in place. The exterior surface of the housing 12 is preferably comprised of walls having one or more layers of plywood, siding, veneer, or the like, thereon. The veneer may take the form of brick, stone, stucco, or the like, externally secured to the walls, so as to blend in, match, or appear to be part of the apartment, residence or office in front of which the mailbox is located.

If the mailbox 10 of the present invention is set back from the curbside, as in some older homes, the door 22 may be placed at the front, since there will be no danger that the person gathering the mail will have to go into a street and/or dodge parked cars.

As shown most clearly in FIG. 4, the combination integral or unitary receiving and outgoing mail element or component 14 is comprised of a single housing having a front door 36 pivotably mounted in a housing frame portion 38. Housing frame portion 38 fits into and holds the entire element 14 within an opening 40 formed in a front wall 42 of the rectangular housing 12. One or more support members 41 are secured in and around the opening 40 to support member 14. The front face or housing frame portion 38 is secured to the front wall 42 and the support members 41. An opening 44 is formed in frame 38, and the front door 36 is pivotably moved therein, as by means of a pull tab 46. The opening 44 is preferably divided in half, along its horizontal length, so as to form an upper, enclosed shelf portion 48, sized and dimensioned to form an enclosure for outgoing mail. Upper, enclosed shelf portion 48 extends into the opening 40, and is separated from the opening 50 connected to the internal cavity or chamber 16.

The mailbox 10 may be provided with a flag (not shown), of any desired color, such as red, which may be stored in the outgoing shelf or slot 48 when not in use. When used, the flag may be inserted in a notch or slot formed in the cap 24.

As explained earlier, when front door 36 is opened by pull tab 46, incoming mail is inserted in the lower opening 50, and drops down into the internal chamber 16 until it comes to rest on the tiles 20 on the shelf 18. The incoming mail can then be retrieved, at any desired time, by unlocking lock 52 in the rear door 22 and opening the rear door. The unitary element 14 and the door 22 are preferably made from a strong plastic or metal, such as stainless steel. The door 36 is pivotably held in the front frame 38, and the door 22 is pivotably held in a lower, rear frame 54. Frame 38 is securely held in the front face 42 and frame 54 is secured in a rear face of the housing 12, in any desired manner, such as being bolted or screwed therein.

Figure 1:
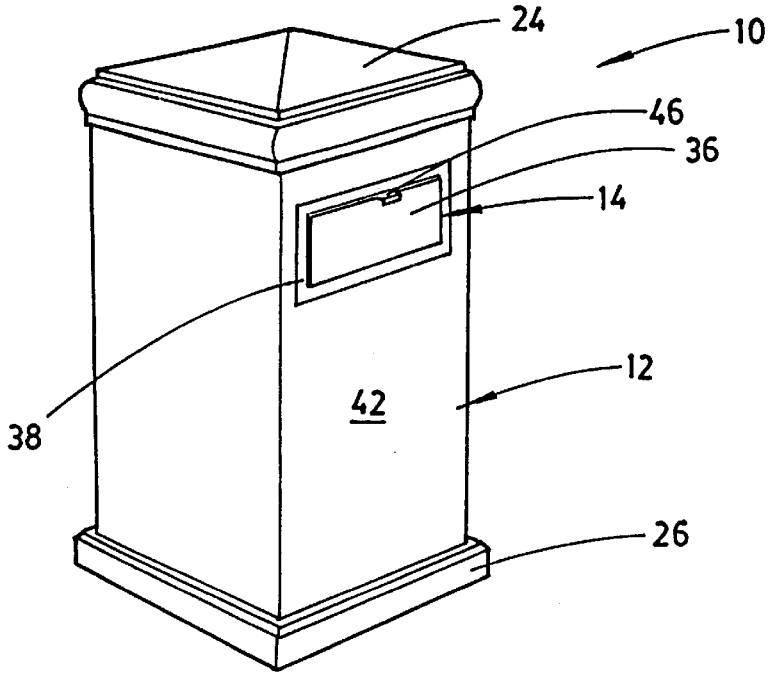
FIG. 1 is a front perspective view of one embodiment of a security mailbox of the present invention.
Figure 2:
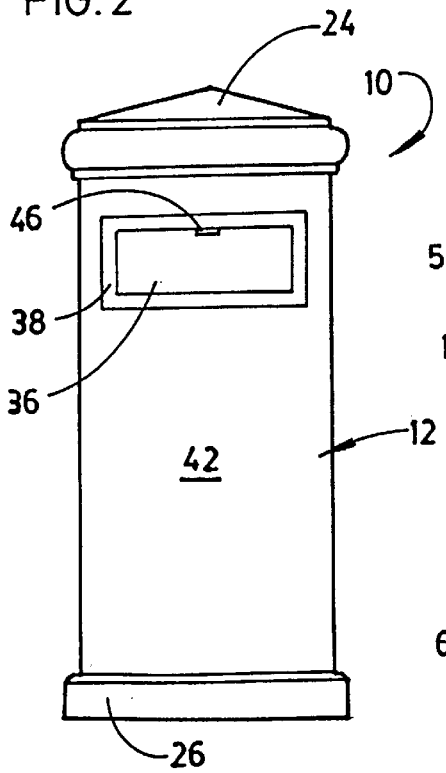
FIG. 2 is a front elevational view of the security mailbox of FIG. 1.
Figure 3:
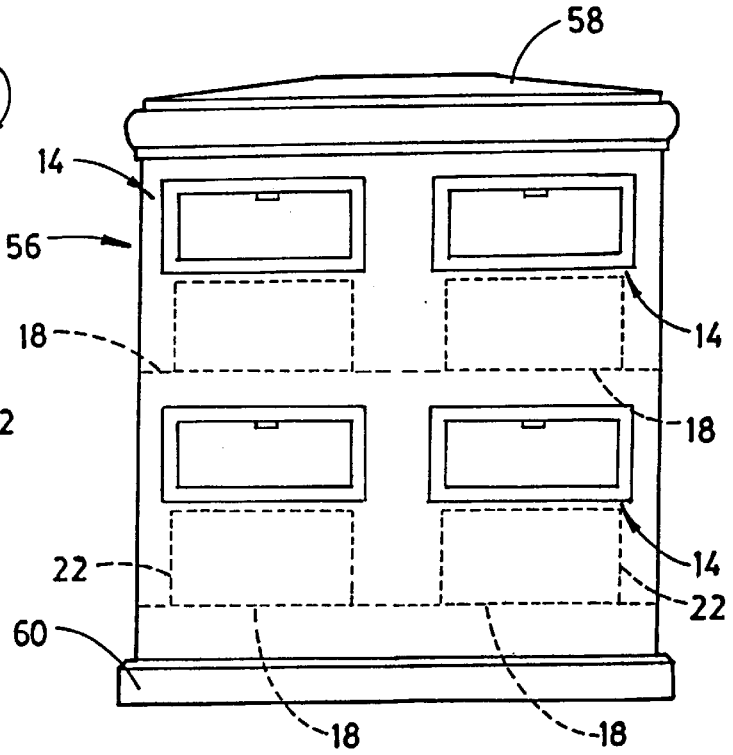
FIG. 3 is a front elevational view of a second embodiment of the security mailbox of the present invention.

Turning now to FIG. 3, there shown is a modified housing 56, having a plurality of separate unitary mail receiving/outgoing elements 14, held therein. An equal number of internal shelves 18 and rear doors 22 are supported in housing 56 to form separate mail receiving areas. It is to be understood that 2, 4, 6, or even more separate unitary elements and corresponding shelves and rear doors may be contained in the rectangular housing 56, in an aesthetically pleasing manner to provide security mailboxes for 2, 4, 6, etc. different entities.

The present invention provides an aesthetically pleasing, security mailbox, which can be used in any setting, and which is acceptable to the U.S. Postal Service, for both outgoing mail, and the insertion and safekeeping of incoming mail for one or more parties.

Those skilled in the art will appreciate the various adaptations and modifications of the just-described preferred embodiments can be configured without departing from the scope and spirit of the invention. Therefore, it is to be understood that, within the scope of the appended claims, the invention may be practiced other than is specifically described herein.

What is claimed is:

1. A security mailbox comprising, in combination:

a rectangular housing having a plurality of vertical corner members, an upper horizontal portion and a lower horizontal portion;

a base secured to the lower horizontal portion;

a decorative top cap secured to the upper horizontal portion;

a front wall, two side walls and a rear wall secured to the plurality of vertical corner members, the lower horizontal portion and the upper portion and forming an internal chamber;

a plurality of unitary combination incoming mail receiving and outgoing mail holding elements secured in an equal number of openings formed in the front wall;

each of the plurality of unitary combination incoming mail receiving and outgoing mail holding elements includes a front frame surrounding an opening having a door pivotably mounted therein; the door includes a pull tab, and the opening in the front frame is divided between a mail receiving slot connected to one of a plurality of mail receiving shelves, and a separate enclosed outgoing mail tray;

the plurality of mail receiving shelves secured in the internal chamber, below the plurality of unitary combination incoming mail receiving and outgoing mail holding elements, and above the base; and a plurality of locking doors, equal to and aligned with the plurality of mail receiving shelves, secured in an equal number of openings formed in the rear wall.

2. The security mailbox of claim 1 wherein each of the plurality of locking doors is pivotably held in a surrounding frame.

* * * * *